US006123053A

United States Patent [19]

Hara et al.

[11] Patent Number: 6,123,053

[45] Date of Patent: Sep. 26, 2000

[54] VARIABLE VALVE ACTUATION APPARATUS FOR INTERNAL COMBUSTION ENGINES

[75] Inventors: Seinosuke Hara; Makoto Nakamura; Tetsuro Goto; Yoshihiko Yamada; Keisuke Takeda, all of Kanagawa, Japan

[73] Assignees: Unisia Jecs Corporation, Atsugi; Nissan Motor Co., Ltd., Yokohama, both of Japan

[21] Appl. No.: 09/316,213

[22] Filed: May 21, 1999

[30] Foreign Application Priority Data

May 21, 1998 [JP] Japan ..... 10-139072
Oct. 2, 1998 [JP] Japan ..... 10-281479

[51] Int. Cl.[7] ..... F01L 13/00

[52] U.S. Cl. ..... 123/90.16; 123/90.17; 123/90.6

[58] Field of Search ..... 123/90.15, 90.16, 123/90.17, 90.31, 90.22, 90.39, 90.6; 74/567, 568 R

[56] References Cited

U.S. PATENT DOCUMENTS 4,397,270 8/1983 Aoyama ..... 123/90.16
5,899,180 5/1999 Fischer ..... 123/90.16
5,924,334 7/1999 Hara et al. ..... 74/568 R
5,937,809 8/1999 Pierik et al. ..... 123/90.16
5,988,125 11/1999 Hara et al. ..... 123/90.16
5,996,540 12/1999 Hara ..... 123/90.16

FOREIGN PATENT DOCUMENTS 2 323 894 10/1998 United Kingdom .

*Primary Examiner*—Wellun Lo
*Attorney, Agent, or Firm*—Foley & Lardner

[57] ABSTRACT

A variable valve actuation apparatus incorporates a mechanism, mounted to a control shaft, to convert rotational motion of a camshaft into pivotal motion of a valve operating cam. The mechanism has different states corresponding to varying angular positions which the control shaft is adjustable to, respectively, The mechanism is continuously variable in state to one of the different states in response to a shift of the control shaft to one of the varying angular positions. The mechanism is also operative to vary the valve operating cam, in position, relative to the associated cylinder valve in response to a shift between the different states.

3 Claims, 14 Drawing Sheets

FIG.17
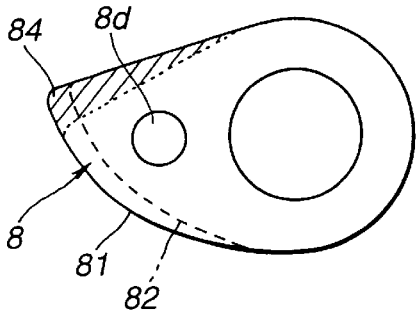
FIG.18(A)
FIG.18(B)
FIG.18(C)
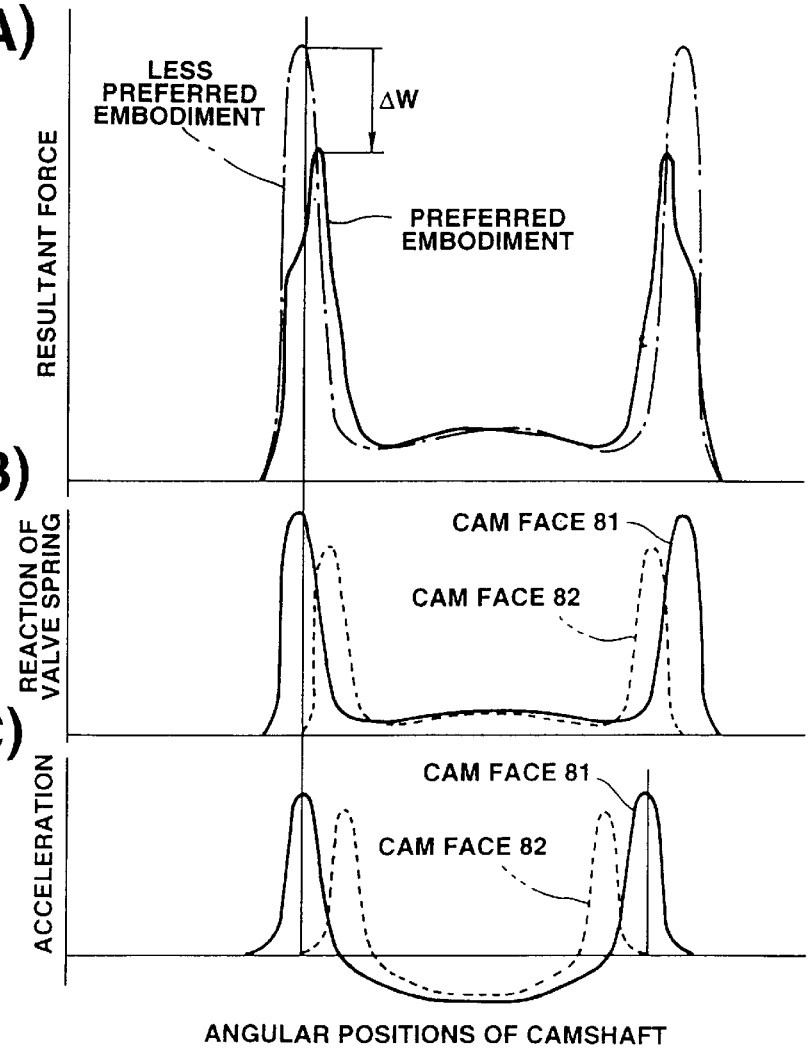

ANGULAR POSITIONS OF CAMSHAFT

VARIABLE VALVE ACTUATION APPARATUS FOR INTERNAL COMBUSTION ENGINES

FIELD OF THE INVENTION

The present invention relates to a variable valve actuation (VVA) apparatus for an internal combustion engine

BACKGROUND OF THE INVENTION

U.S. Pat. No. 4,397,270 discloses a variable valve timing and lift system. It includes a driving or shaft (which may be called a camshaft), a control shaft with axially spaced eccentric position controlling cams, and a pivot structure. The pivot structure supports valve operating (VO) cams for pivotal motion above valve lifters of cylinder valves. Springs are mounted for the VO cams, respectively. Each of the springs biases one of the corresponding rocker arms toward its rest position where the associated cylinder valve closes. Rocker arms operate the VO cams, respectively. The eccentric position controlling cams, which are in rotary unison with the control shaft, bear the rocker arms, respectively. An axis of each of the eccentric position controlling cams serves as the center of drive of the corresponding one of the rocker arms. Driver cams fixed to the driving shaft operate the rocker arms, respectively. An electronic control module (ECM) is provided. Sensors on the engine send information on engine speed, engine load, vehicle speed, and coolant temperature to the ECM. At a predetermined switchover point, the ECM sends a signal to an actuator for the control rod. As the actuator turns the control rod, the eccentricity of each of the eccentric position controlling cams with respect to an axis of the control shaft changes. This alters the position of pivot center of the rocker arms relative to the position of pivot center of the VO cams. This causes variation in valve timing and lift of each of the cylinder valves.

According to this known system, the camshaft is not mounted above the cylinder valves. This arrangement has a potential problem that the considerable modification of the conventional overhead camshaft engine is required to install the camshaft.

Co-pending U.S. patent applications Ser. Nos. 09/130,490 (filed on Aug. 7, 1998 by Seinosuke HARA et al.) now U.S. Pat. No. 5,988,125, and 09/219,774 (filed on Dec. 23, 1998 by Makoto NAKAMURA et al.) have been commonly assigned herewith and disclose various variable valve actuation apparatuses for Internal combustion engines.

GB 2 323 894 A, published on Oct. 7, 1998, discloses another type of variable actuation apparatus for an internal combustion engine.

The variable valve actuation apparatuses, which has been disclosed by the co-pending U.S. patent applications Ser. Nos. 09/130,490, 09/119,774 and GB 2 323 894 A are fairly well developed. However, a need remains for further development of such variable valve actuation apparatuses.

SUMMARY OF THE INVENTION

According to the present invention, there is provided a variable valve actuation apparatus for an internal combustion engine having a plurality of cylinders, comprising:

a first cylinder valve;

a second cylinder valve, said first and second cylinder valves being arranged for one of the plurality of cylinders to perform one of intake and exhaust phases of the one cylinder, each of said first and second cylinder valves being biased by a valve spring toward a valve close position thereof;

a camshaft adapted for rotation about a camshaft axis;

a first valve operating cam cooperating with said first cylinder valve, said first valve operating cam being arranged for pivotal motion, about a pivotal axis thereof, to lift said first cylinder valve toward a valve open position thereof against the valve spring thereof;

a second valve operating cam cooperating with said second cylinder valve to lift said second cylinder valve toward a valve open position thereof against the valve spring thereof;

a control shaft adjustable to varying angular positions with respect to a control shaft axis; and a mechanism, mounted to said control shaft, to convert rotational motion of said camshaft into pivotal motion of said first valve operating cam, said mechanism having different states corresponding to said varying angular positions which said control shaft is adjustable to, respectively, and being continuously variable in state to one of said different states in response to a shift of said control shaft to one of said varying angular positions, said mechanism being operative to vary said first valve operating cam, in position, relative to said first cylinder valve in response to a shift between said different states.

BRIEF DESCRIPTION OF THE DRAWINGS

FIG. 7 plots varying magnitudes of a maximum valve lift of each of first and second cylinder valves for one cylinder against varying angular position which a control shaft of the VVA apparatus is adjustable to.

FIG. 17 illustrates the profile an alternative valve operating (VO) cam.

FIG. 18(A) illustrates varying magnitudes of resultant force acting on the VO cam of the fifth embodiment against varying angles of a camshaft.

FIG. 18(B) illustrates varying magnitudes of first force components acting on the VO cam through first and second cam faces due to valve springs against varying angles of the camshaft.

FIG. 18(C) illustrates varying magnitudes of second force components acting on the VO cam through the first and second cam faces due to acceleration which the associated valve lifters are subject to against varying angles of the camshaft.

DESCRIPTION OF THE PREFERRED EMBODIMENTS

Figure 1:
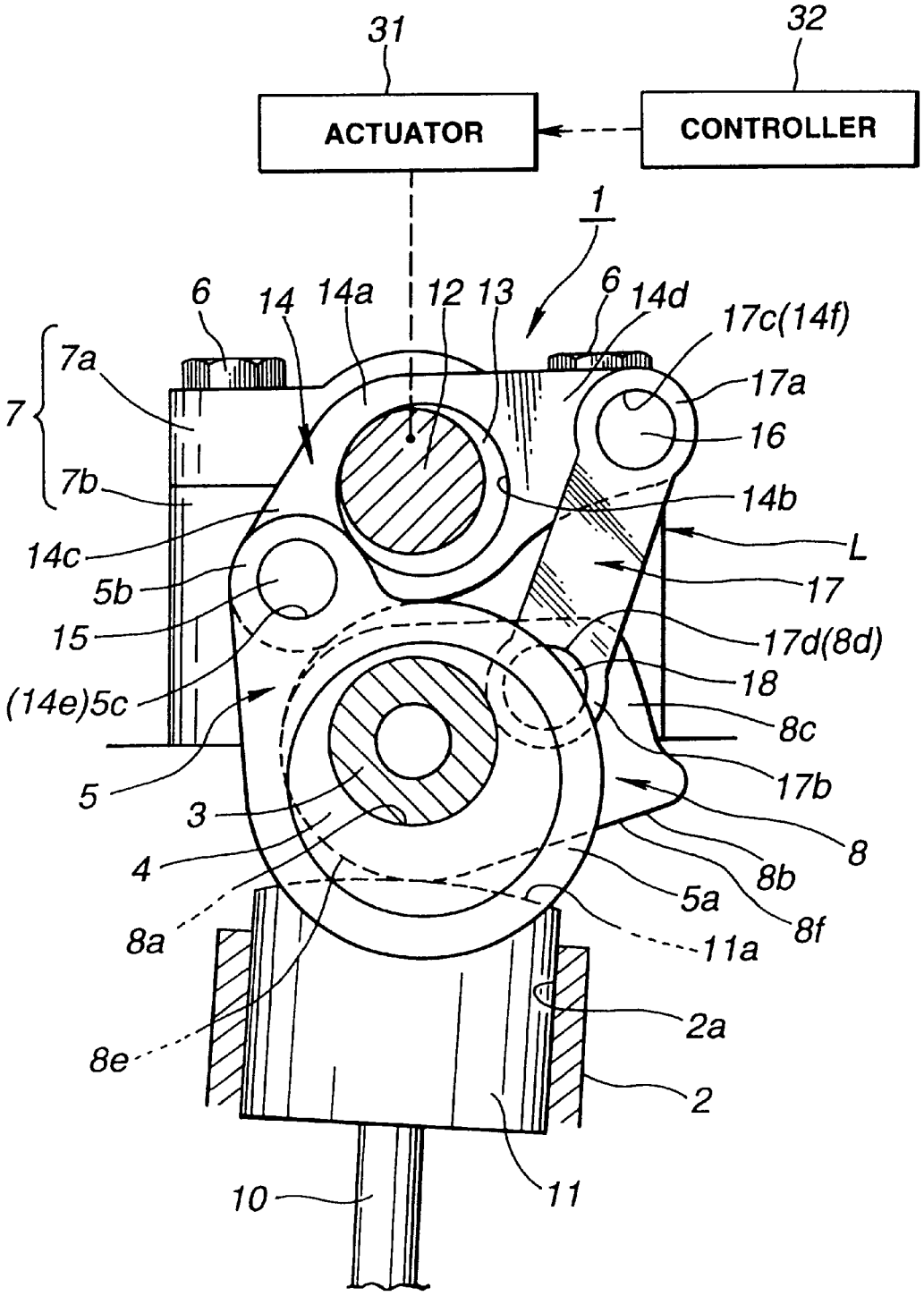
FIG. 1 illustrates diagrammatically, in a cross sectional view, a cylinder head portion of an internal combustion engine equipped with a first embodiment of a VVA apparatus.
Figure 2:
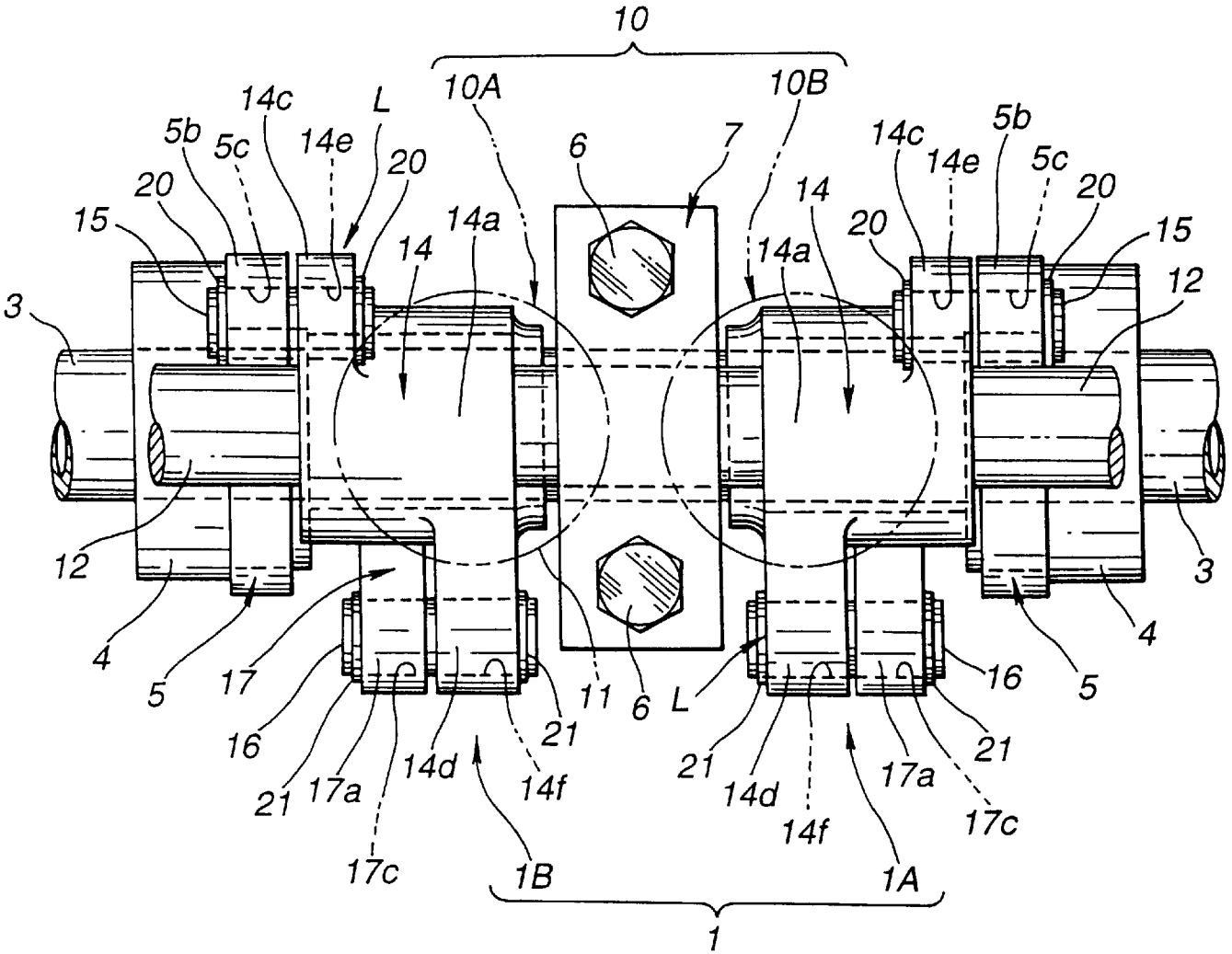
FIG. 2 illustrates diagrammatically, in a top plan view, an intake valve side of the cylinder head portion shown in FIG. 1.
Figure 3:
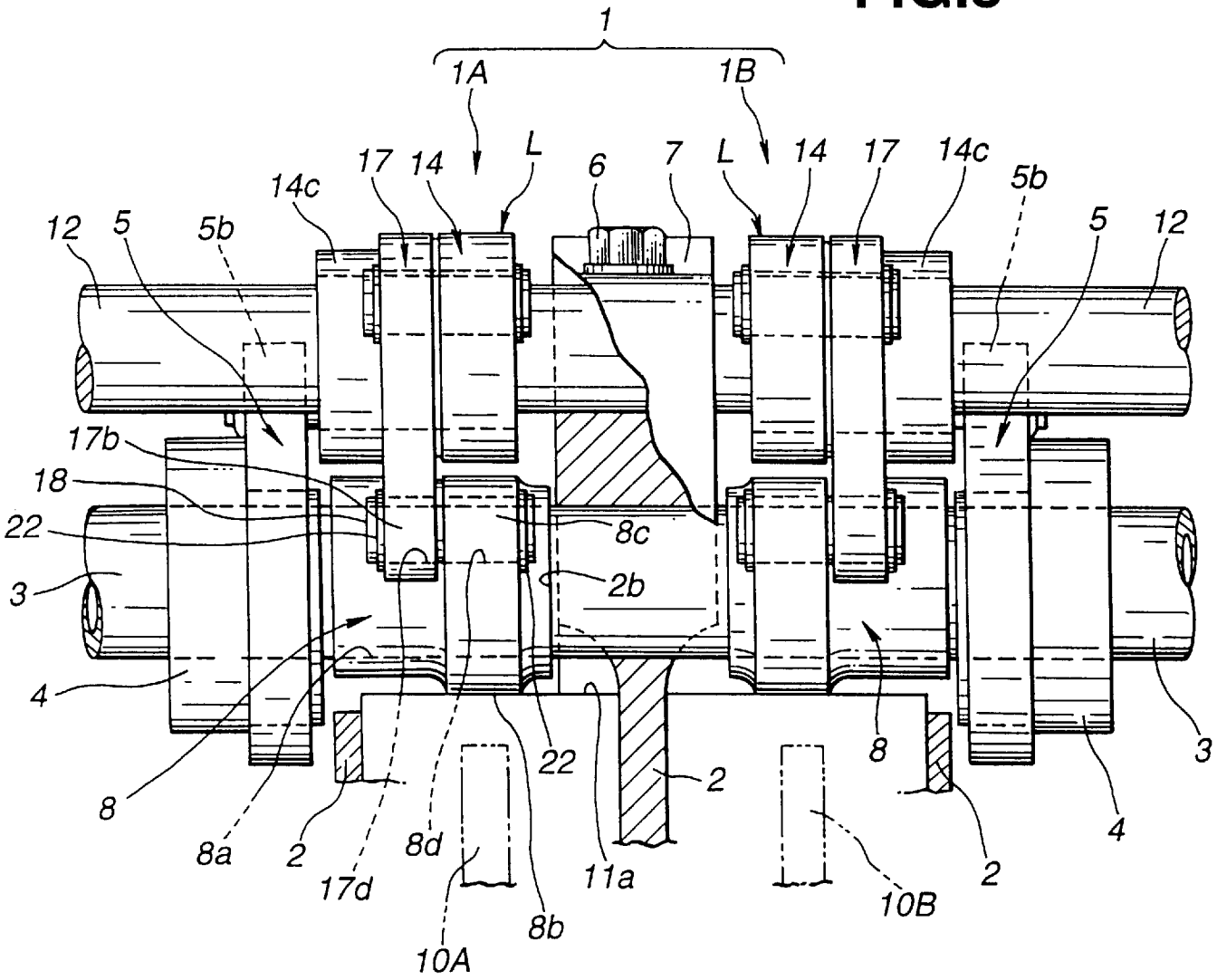
FIG. 3 illustrates diagrammatically, in a front elevation view, the intake valve side of the cylinder head portion shown in FIG. 2.

Referring to FIGS. 1 to 4, a variable valve actuation (VVA) apparatus is generally designated by the reference numeral 1. FIGS. 1 to 3 illustrate an intake valve side portion of a cylinder head of an internal combustion engine having a plurality of cylinders. The engine has four cylinder valves per cylinder. They include a pair of intake valves, generally designated by the reference numeral 10 in FIGS. 2 and 3, and a pair of exhaust valves (not shown).

In this example, the VVA apparatus 1 includes a first cylinder valve and a second cylinder valve which are arranged for one of the plurality of cylinders to perform one of intake and exhaust phases of the one cylinder. In other words, the first and second cylinder valves open when the associated one cylinder performs the intake or exhaust phase. The VVA apparatus 1 is described hereinafter taking a first intake valve 10A and a second intake valve 10B, which constitute the pair of intake valves 10, as example of the first and second cylinder valves. Each of the cylinder valves is biased by a valve spring, not shown, toward a valve close position thereof. Guide bores 2*a* (see FIG. 1) of a cylinder head 2 receive valve lifters 11 of the intake valves 10A and 10B, respectively.

Cam bearings, only one being shown at 7, on the cylinder head 2 support a driving shaft 3, which may be called a camshaft, and a control rod 12, which may be called a control shaft. The camshaft 3 is disposed above and in operative association with valve litters 11 of the intake valves 10A and 10B. The cam bearing 7 includes a main bracket 7*b* that holds the camshaft shaft 3 on the cylinder head 2. A subordinate bracket 7*a* holds the control shaft 12 on the main bracket 7*b* in spaced relationship with the camshaft shaft 3. A pair of fasteners in the form of bolts 6 fixedly secures the brackets 7*a* and 7*b* to the cylinder head 2. A crankshaft (not shown) provides drive force from the engine to the camshaft 3 via pulleys and a timing chain. The camshaft 13 extends from a front end of the cylinder head 2 to a rear end thereof.

The VVA apparatus 1 may be divided into two sub-assemblies 1A and 1B as shown in FIGS. 2 and 3. The two sub-assemblies 1A and 1B are disposed on the left and right sides of the associated cam bearing 7.

Figure 4:
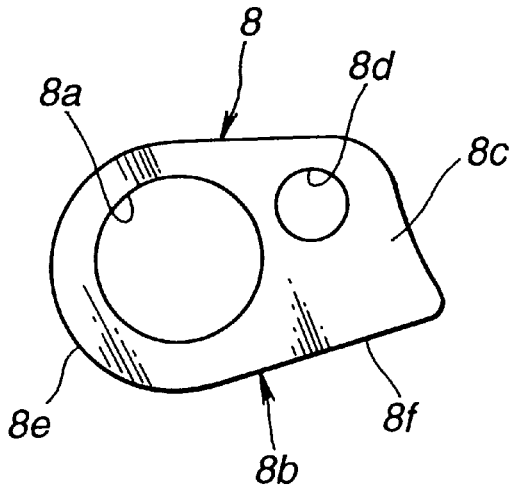
FIG. 4 illustrates the profile a valve operating (VO) cam of the first embodiment of the VVA apparatus.

The camshaft 3 has two axially spaced first and second driver cams 4, 4 per each cylinder. As best seen in FIG. 1, each driver cam 4 is an eccentric circular rotary cam fixedly mounted, in press-fit manner, to the camshaft 3. The first and second driver cams 4, 4 are axially spaced in directions away from the cam bearing 7. This arrangement allows layout of a first valve operating (VO) cam 8 for cooperation with the first intake valve 10A and a second VO cam 8 for cooperation with the second intake valve 10B. Each of the first and second VO cams 8 is formed with a hole 8*a* and has a cam face 8*b* for diving contact with a top surface 11*a* of the associated valve lifter 11. Each of the first and second VO cams 8 has an edge portion 8*c* formed with a pin-receiving hole 8*d*. Referring to FIGS. 1 and 4, the cam face 8*b* includes a base circle portion 8*e* that defines a base circle about a camshaft axis about which the camshaft 3 rotates. It also includes a ramp portion that defines a ramp, and a lift portion 8*f* that defines a cam lift.

The camshaft 3 extends through the hole 8*a* of each of the first and second VO cams 8, 8 with a clearance to allow pivotal motion of the VO cam about a pivotal axis. Setting of such clearance is such that the pivotal axis and the camshaft axis coincide.

Figure 5A:
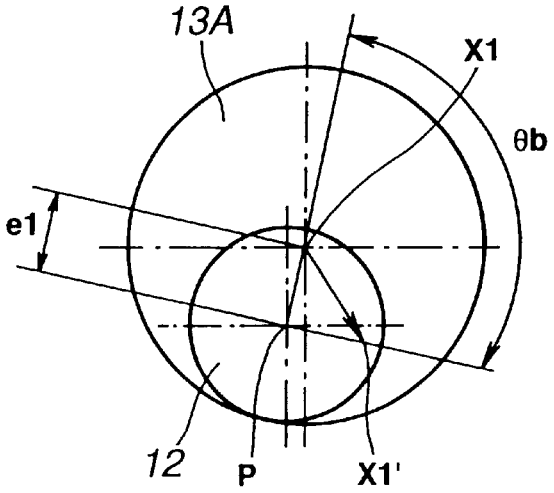
FIG. 5(A) illustrates the profile of a first positioning cam on a control shaft for adjusting effective angular range of a first VO cam cooperating with a first intake valve provided above a cylinder.
Figure 5B:
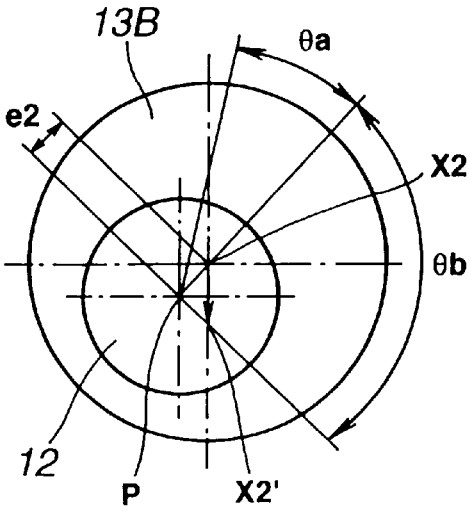
FIG. 5(B) illustrates the profile of a second positioning cam on the control shaft for adjusting effective angular range of a second VO cam cooperating with a second intake valve provided above the cylinder.

The control shaft 12 has a control shaft axis and is adjustable to varying angular positions with respect to the control shaft axis. The VVA apparatus 1 comprises a mechanism mounted to the control shaft 12. This mechanism is so constructed and arranged as to convert rotational motion of the camshaft 3 into pivotal motion of the first and second VO cams 8, 8. The mechanism includes the first and second driver cams 4, 4 fixedly mounted to the camshaft 3. It also includes two mutually spaced position controlling (PC) cams 13 mounted to the control shaft 12. Referring to FIGS. 5(A) and 5(B), the two PC cams 13 include a first position controlling (PC) cam 13A and a second position controlling (PC) cam 13B. The first and second PC cams 13A and 13B are fixedly mounted to the control shaft 12. The second PC cam 13B is spaced along the control shaft axis P from the first PC cam 13A. The mechanism further includes a first linkage system L and a second linkage system L. As viewed in FIG. 3, the first linkage system L is disposed on the left side or the cam bearing 7 and includes a first rocker arm 14 mounted to the first PC cam 13A. The second linkage system L is disposed on the right side of the cam bearing 7 and includes a second rocker arm 14 mounted to the second PC cam 13B. The first rocker arm 14 is pivotal about an axis X1 of the first PC cam 13A, and the second rocker arm 14 is pivotal about an axis X2 of the second PC cam 13B.

The first and second rocker arms 14, 14 have sleeves 14*a*, 14*a* that are formed with bores 14*b*, 14*b* receiving the first and second PC cams 13A, 13B, respectively. The sleeves 14*a*, 14*a* can rotate relative to the PC cams 13A, 13B about the PC cam axes X1, X2, respectively. Viewing in FIGS. 2 and 3, the first and second rocker arms 14, 14 on the left and right sides of the cam bearing 7 are in mirror image relationship with respect to a hypothetical vertical plane bisecting the cam bearing 7. The two rocker arms 14, 14 that are in mirror image relationship have first arms 14*c*, 14*c* and second arms 14*d*, 14*d*. The first arms 14*c*, 14*c* extend outwards from the sleeves 14*a*, 14*a* and define the remotest ends of the sleeves 14*a*, 14*a* of the first and second rocker arms 14, 14 from the cam bearing 7. The second arms 14*d*, 14*d* extend outwards from the sleeves 14*a*, 14*a* and define the nearest ends of the sleeves 14*a*, 14*a* to the cam bearing 7.

The first arms 14*c*, 14*c* are in driving cooperation with the associated driver cams 4, 4, respectively. The second arms 14*d*, 14*d* are in driving cooperation with the associated VO cams 8, 8. The first arms 14*c*, 14*c* and the associated driver cams 4, 4 are interconnected by crank arms 5, 5. The second arms 14*d*, 14*d* and the associated VO cams 8, 8 are interconnected by links 17, 17.

As best seen in FIG. 1, each crank arm 5 includes an annular base portion Sa and an integral radial extension 5*b*. The annular base portion 5*a* has a cylindrical bore, which receives the associated driver cam 4. The radial extension 5*b* includes a hole 5*c*, which receives a pin 15 that is received in a hole 14*e* drilled through the first arm 14*c* of the associated rocker arm 14. Snap rings 20 engage one and the opposite protruded end portions of the pin 15 to prevent its removal.

Each link 17 has circular ends 17*a* and 17*b*. The circular end 17*a* is formed with a hole 17*c*, which receives a pin 16 that is received in a hole 14*f* drilled through the second arm 14*d*. Snap rings 21 engage one and the opposite protruded end portions of the pin 16 to prevent its removal. The other circular end 17*b* is formed with a hole 17*d*, which receives a pin 18 that is received in the hole 18*d* drilled through the associated VO cam 8. Snap rings 22 engage one and the opposite protruded end portions of the pin 18 to prevent its removal.

An actuator 31 is drivingly coupled with the control shaft 12. A controller 32 is connected to the actuator 31. Sensors on the engine send information on engine speed, engine load, vehicle speed, and coolant temperature to the controller 32. Based on the information from the sensors, the controller determines a current operating state of the engine and a signal appropriate to the determined state. The controller 32 sends the determined signal to the actuator 31.

Further detailed and/or related description on the VVA apparatus 1 may be found in the before-mentioned co-pending U.S. patent applications Ser. Nos. 09/130,490 (Seinosuke HARA et al.) and 09/219,774 (Makoto NAKAMURA et al.), both of which have been hereby incorporated by reference in their entireties.

The VVA apparatus 1 operates in the following manner. In operation of the engine, the camshaft 3 rotates, causing each driver cam 4 to rotate about the camshaft axis eccentrically. This eccentric motion of the driver cam 4 causes the associated crank arm 5 to pivot the associated rocker arm 14 about the axis of the associated PC cam 13A or 13B. This pivotal motion of the rocker arm 14 causes the associated link 17 to pivot the associated VO cam 8 about the axis of the camshaft 3. This pivotal motion of the VO cam 8 brings the face cam 8*b* into contact with the top 11*a* of the associated valve lifter 11, lifting the valve lifter 11 against its valve spring to open the associated intake valve 10.

In response to the signal from the controller 32, the actuator 31 can adjust the control shaft 12 to any one of varying angular positions, which are arranged within a predetermined angular range with respect to the control shaft axis. The mechanism includes the linkage systems L with the rocker arms 14 and has varying operative positions with the varying angular positions, which the control shaft 12 is adjustable to. Rotating the control shaft 12 from a current angular position to a desired angular position causes the PC cams 13A and 13B to move eccentrically. This eccentric movement of each of the PC cams 13A and 13B causes the associated linkage system L to switch from a current position to a new position. Within a hypothetical plane in which one of the VO cam 8 pivots, a vector may be drawn, which originates at the axis of the camshaft 3 and terminates at the axis of the PO cam 13A or 13B of the associated linkage system L. The magnitude and direction of such vector when the linkage system L is in the current position differ from those when the linkage system L is in the new position. Thus, this vector describes a position, which the linkage system L takes. Varying the position of each linkage system L varies an angular position of the associated VO cam 8 at which the cam face 8*b* begins to lift the associated valve lifter 11 against the valve spring. This results in variation in valve open and close timings and valve lift of the associated intake valve 10.

Assuming now that the control shaft 12 is rotated clockwise from the illustrated position viewing in FIG. 1, the pivot axis of the rocker arm 14 comes nearer to the axis of the camshaft 3 about which the VO cam 8 pivots. Besides, the linkage system L displaces the VO cam 8 clockwise. Thus, the phase of the VO cam 8 advances, causing the valve open timing of the associated intake valve 10 to advance. The VO cam 8 can pivot through angles that are unaltered over varying positions which the linkage system L may take. Thus, the maximum lift of the intake valve 10 is elevated. The angular positions, which the control shaft 12 may take, are continuous and the positions which each linkage system L may take are continuous.

FIGS. 5(A) and 5(B) illustrate the preferred implementation of the present invention. In this embodiment, the control shaft 12 is allowed to rotate about its axis P from a first angular position (γa) to a second angular position (γb) over a predetermined adjustable range that covers a predetermined angle of γb. During this rotation of the control shaft 12, the axis of the first PC cam 13A moves from a point X1 to a point X1', while the axis of the second PC cam 13B moves from a point X2 to a point X2'. The axis of the first PC cam 13A and the axis of the second PC cam 13B are eccentric with respect to the axis P of the control shaft 12. The amount of eccentricity of the first PC cam 13A, as indicated by e1, is greater than the amount of eccentricity of the second PC cam 13B, as indicated by e2. The direction of eccentricity of the first PC cam 13A is retarded in phase from the direction of eccentricity of the second PC cam 13B through a predetermined angle of θa about the axis P.

Figure 6A:
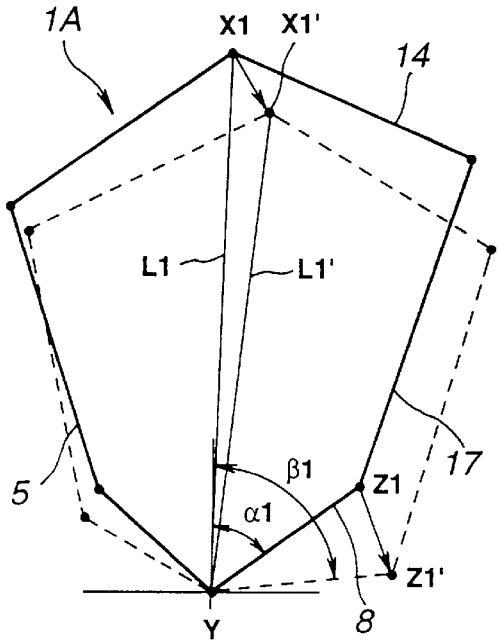
FIG. 6(A) is a linkage diagram illustrating the operation of a first linkage system of the VVA apparatus.
Figure 6B:
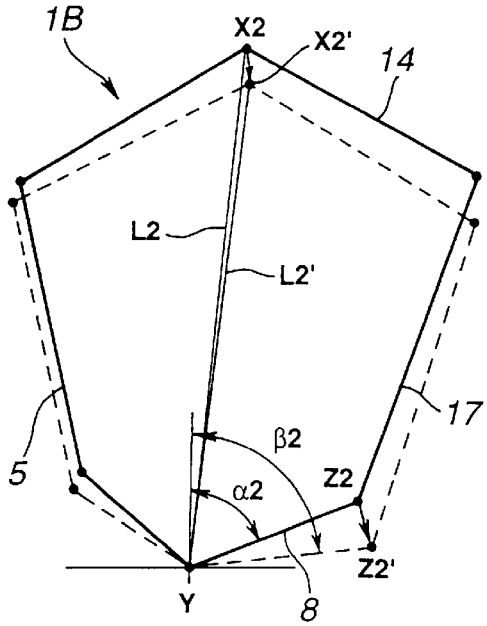
FIG. 6(B) is a linkage diagram illustrating the operation of a second linkage system of the VVA apparatus.

FIG. 6(A) is a very simplified illustration of the linkage system incorporating the first PC cam 13A. FIG. 6(B) is a very simplified illustration of the linkage system incorporating the second PC cam 13B. In FIG. 6(A), the fully drawn line shows the position of links of the linkage system incorporating the first PC cam 13A when the control shaft 12 is at the first angular position γa, while the broken line shows the position of the links when the control shaft 12 is at the second angular position γb. In FIG. 6(B), the fully drawn line shows the position of links of the linkage system incorporating the second PC cam 13B when the control shaft 12 is at the first angular position γa, while the broken line shows the position of the links when the control shaft 12 is at the second angular position γb. In the linkage system illustrated in FIG. 6(A), rotation of the control shaft 12 from the first angular position to the second angular position causes the axis of the rocker arm 14 to move from the point X1 to the point X1' and the axis of the pin 18 to move from a position Z1 to a position Z1'. The axis of the camshaft 3, about which the VO cam 8 pivots, remains unaltered at an immobile point Y. In the linkage system illustrated in FIG. 6(B), rotation of the control shaft 12 from the first angular position to the second angular position causes the axis of the rocker arm 14 to move from the point X2 to the point X2' and the axis of the pin 18 to move from a position Z2 to a position Z2'. The axis of the camshaft 3, about which the VO cam 8 pivots, remains unaltered at the immobile point Y.

In FIG. 6(A), the reference character L1 represents a distance between the immobile point Y and the axis of the rocker arm 14 in the linkage system incorporating the first PC cam 13A when the control shaft 12 is at the first angular position γa. The reference character L1' represents the distance when the control shaft 12 is at the second angular position γb. In FIG. 6(B), the reference character L2 represents a distance between the immobile point Y and the axis of the rocker arm 14 in the linkage system incorporating the second PC cam 13B when the control shaft 12 is at the first angular position γa. The reference character L2' represents the distance when the control shaft 12 is at the second angular position γb.

In this embodiment, when the control shaft 12 is at the first angular position γa, the phase of the axis of the pin 18 with respect to a center line of the associated valve lifter 11 is expressed by an angle α1 in the linkage system incorporating the first PC cam 13A, see FIG. 6(A), and it is expressed by an angle α2 in the linkage system incorporating the second PC cam 13B, see FIG. 6(B). The setting is such that the distance L1 is greater than the distance L2. Thus, the phase α1 is less than the phase α2. The VO cams 8 used in the both linkage systems have the same cam profile as shown in FIG. 4 and the same cam faces 8*b*. The valve opening timing of the First intake valve 10A becomes retarded as compared to that of the second intake valve 10B and the amount of lift of the first intake valve 10A becomes small as compared to that of the second intake valve 10B.

Figure 7:
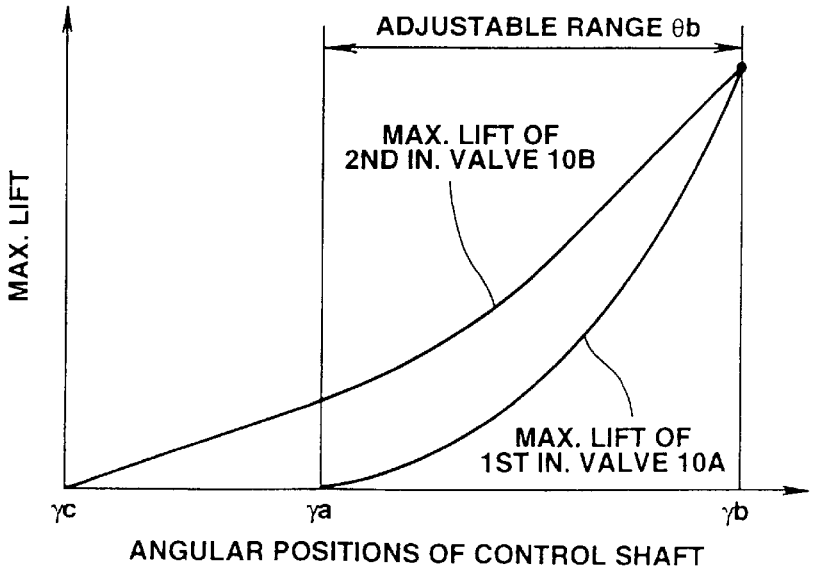

FIG. 7 illustrates plotting of maximum lift of the first intake valve 10A and that of the second intake valve 10B against varying angular positions of the control shaft 12. The first and second PC cams 13A and 13B are rotated counterclockwise to their limits after the control shaft 12 has been placed at the first angular position γa. In this state, the first intake valve 10A is kept closed because it has a zero lift. The second intake valve 10B is opened in response to rotation of the camshaft 3 because it has some magnitude of lift. Thus, the second intake valve 10B is opened for admission of intake air into the cylinder with the first intake valve 10A kept closed.

In other words, the setting is predetermined such that the phase of the first PC cam 13A is retarded from the phase of the second PC cam 13B by the angle θa to keep the first intake valve 10A closed.

Rotating the control shaft 12 clockwise from the first angular position γa causes a gradual shift of the axis of the first PC cam 13A from the point X1 toward the point X1' and a gradual shift of the axis of the second PC cam 13B from the point X2 toward the point X2'. These gradual shifts cause a gradual reduction of the distance from L1 toward L1' and a gradual reduction of the distance from L2 toward L2'. The amount of eccentricity e1 of the first PC cam 13A is greater than the amount of eccentricity e2, so that the rate at which the distance reduces from L1 to L1' against a unit change in angular position of the control shaft 12 is greater than the rate at which the distance reduces from L2 to L2' against a unit change in angular position of the control shaft 12. Further, the rate at which the phase of the axis of the pin 18 increases from Z1 to Z1' against a unit change in angular position of the control shaft 12 is greater than the rate at which the phase of the axis of the pin 18 increases from Z2 to Z2'. As a result, the rate at which the valve open and close timings of the first intake valve 10A change and the rate at which the lift of the first intake valve 10B changes against a unit change in angular position of the control shaft 12 are greater than their counterparts of the second intake valve 10B (see FIG. 7).

Subsequently, when the control shaft 12 reaches the is second angular position γb, the distance L1' and the distance L2' become equal to each other as readily seen from FIGS. 6(A) and 6(B). This results in providing the maximum lift of the first intake valve 10A as high as the maximum lift of the second intake valve 10B and providing the phase β1 of the axis of the pin 18 generally as great as the phase β2. The lift of the first intake valve 10A varies continuously from the zero level to the level as high as the maximum lift of the second intake valve 10B against varying angular positions of the control shaft 12 from the first angular position γa to the second angular position γb.

If there is a need to generate strengthened swirl within a cylinder for improved fuel economy and combustion at low speed with light load, it is preferable to set the control shaft 12 at the first angular position γa. At high speed with heavy load, it is preferred to set the control shaft 12 at the second angular position γb for increased intake air charging efficiency for enhanced power output at full throttle, The VVA apparatus may be used for operating two exhaust valves per cylinder. In this case, the control shaft 12 is at the first angular position γa at engine start-up at cold temperatures and the subsequent warming up operation. Under this condition, the first exhaust valve is kept closed so that the amount of heat dissipation past the exhaust valves is reduced, keeping the exhaust gas high enough to prompt activation of catalyst within an exhaust gas purifier system.

As is readily seen from the points X1' and X2' in FIGS. 5(A) and 5(B), the axis of the first PC cam 13A does not match the axis of the second PC cam 13B when the control shaft 12 is at the second angular position γb. This causes a difference in valve open and close timings between the first and second intake valves 10A and 10B.

If there is a need to enhance torque at intermediate speeds, it is preferable to employ the setting such that the maximum lift of the first intake valve matches the maximum lift of the second intake valve when the control shaft 12 is at the second angular position γb.

If there is a need to give high power output at high speeds, it is preferable to employ the setting such that the valve open and close timings of the first and second intake valves coincide each other when the control shaft 12 is at the second angular position γb.

According to the embodiment, the control shaft 12 is prohibited to take any angular position outside of the adjustable range. This adjustable range is determined to avoid interference between to the control shaft 12 and the VO cams 8. Thus, if there is enough space between the control shaft 12 and the VO cams 8, the adjustable range may be extended to an angular position γc (see FIG. 7).

According to the embodiment, when the control shaft 12 is at the first angular position γa, the first intake valve 10A is kept closed if situations allow, the first intake valve may open slightly.

Figure 8:
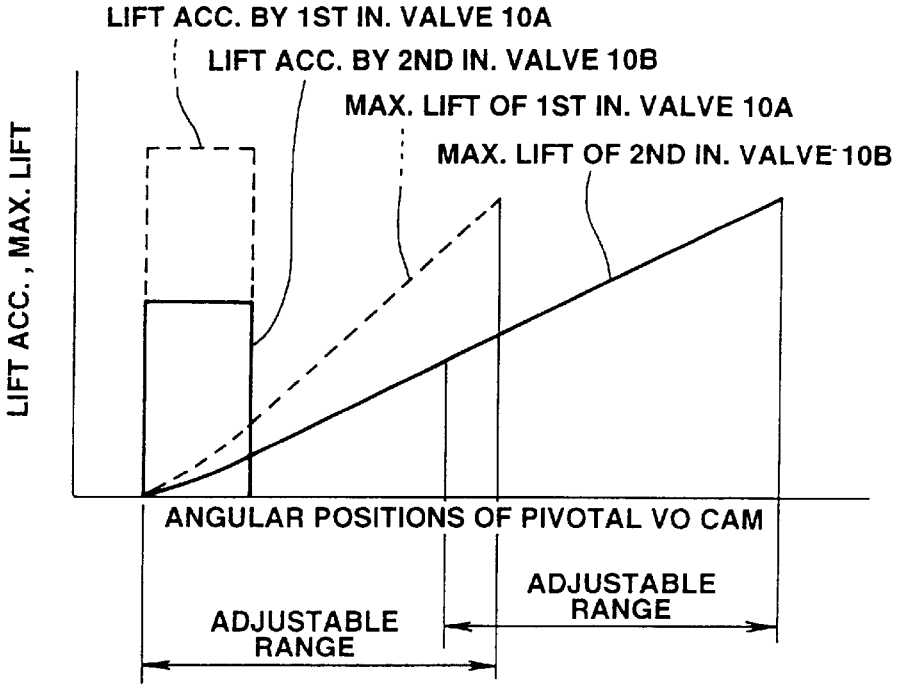
FIG. 8 plots varying magnitudes of a maximum lift and those of a lift acceleration of each of first and second cylinder valves for one cylinder against varying angular positions of each of first and second valve operating (VO) cams used in a second embodiment of the VVA apparatus.

FIG. 6 illustrates the second preferred implementation of the present invention. This second preferred implementation is substantially the same as the first preferred s implementation except the following two differences. The first difference resides in no difference between the eccentricity, in amount, of a first PC cam 13A and that of a second PC cam 13B. Thus, e1=e2 holds. The second difference resides in difference in profile between two VO cams 8, 8. The profile of the VO cam 8 cooperating with a first intake valve 10A is different from that of the other VO cam 8 in the pattern of variation of acceleration which the associated valve lift is subjected to during activation by the VO cam 8. As is readily seen from FIG. 8, the lift acceleration by the VO cam 8 for the first intake valve 10A is greater than that by the other VO cam for the second intake valve 10B. With this difference in cam profile, the rate at which the maximum lift of the first intake valve 10A varies against varying angular positions of a control shaft 12 is greater than the rate of variation of the maximum lift of the second intake valve 10B. The cam profiles of the both VO cams 8, 8 may be selected to match both maximum lift and valve timings of the first intake valve 10A with those of the second intake valve 10B at a second angular position γb of the control shaft 12.

Figure 9:
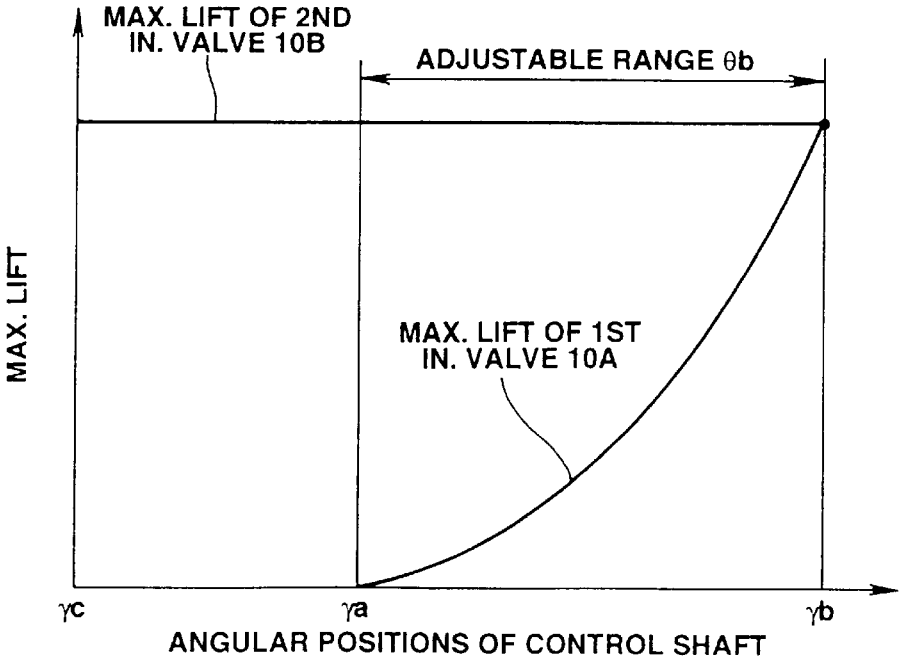
FIG. 9 plots varying magnitudes of a maximum lift of a first cylinder valve against varying angular positions which a control shaft of a third embodiment of the VVA apparatus is adjustable to with the magnitude of a maximum lift of a second cylinder valve unaltered.

FIG. 9 illustrates the third preferred implementation according to the present invention. In this implementation, a first cylinder valve, which may be a first intake valve 10A or a first exhaust valve, is activated by a pivotal VO cam of a VVA apparatus. But a second cylinder valve, which may be a second intake valve 10B or a second exhaust valve, is activated by a conventional rotary cam fixed to a camshaft. In this case, maximum lift of the first intake valve 10A is increased from zero level at a first angular position γa of a control shaft 12 to a level as high as the maximum lift of the second intake valve 10B at a second angular position γb.

Figure 10:
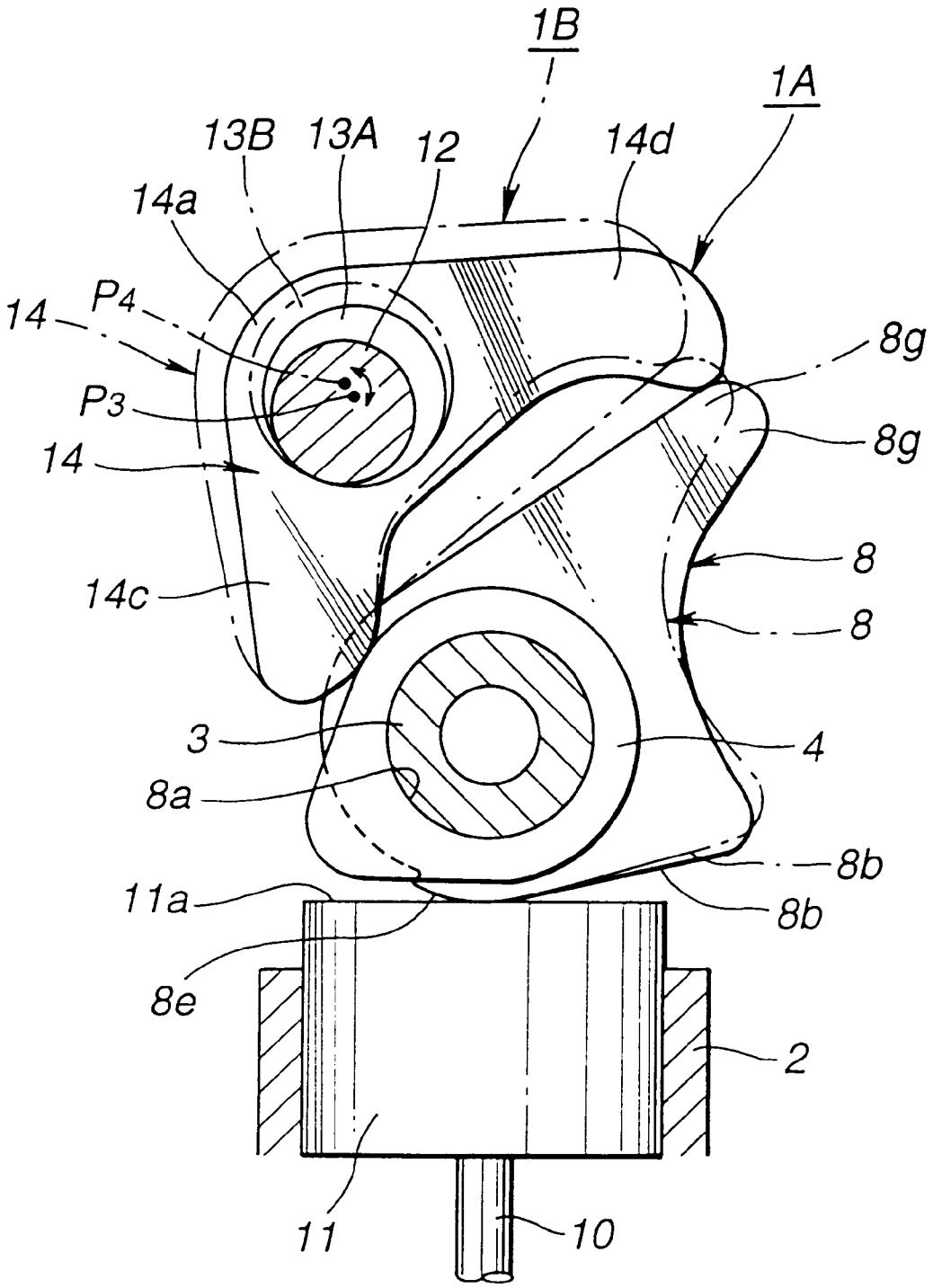
FIG. 10 illustrates diagrammatically, in a cross sectional view, a cylinder head portion of an internal combustion engine equipped with a fourth embodiment of a VVA apparatus in position during engine operation with light or intermediate load.
Figure 11:
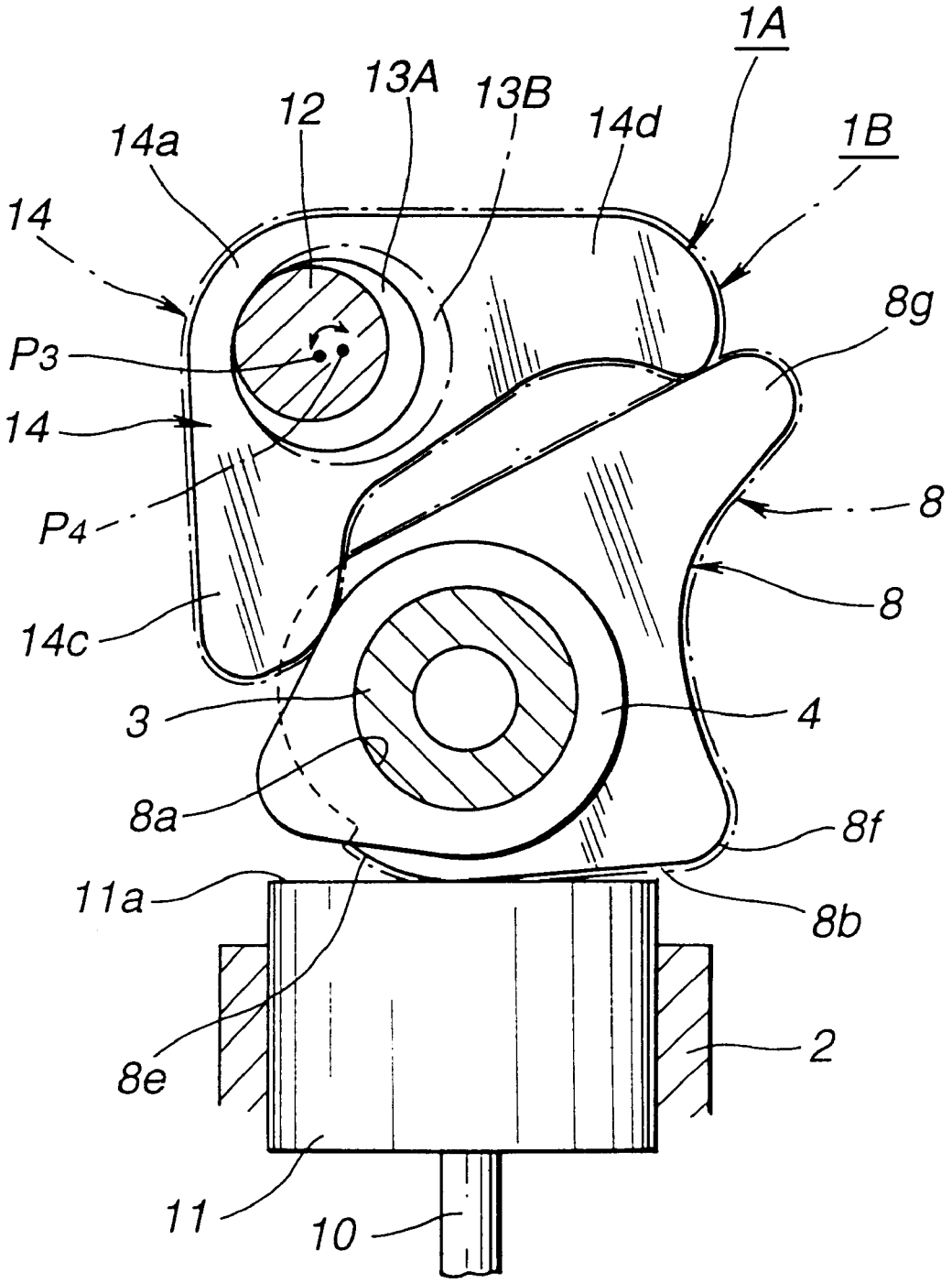
FIG. 11 illustrates the fourth embodiment in its position during engine operation with heavy load.

FIGS. 10 and 11 illustrate the fourth preferred implementation according to the present invention. This fourth preferred implementation is substantially the same as the first preferred implementation in that both use substantially the same first and second PC cams 13A and 13B mounted in the same manner to a control shaft 12, and first and second VO cams 8, 8 have the same profile. The crank arms 5, 5 and the links 17, 17 have been eliminated. Crank arms 14, 14, driver cams 4, 4 and VO cams 8, 8 are slightly modified to accomplish sliding engagement of each driver cam with its associated crank arm and sliding engagement of the crank arm with its associated VO cam.

The driver cams 4, 4 are fixedly mounted, by press-fit, to a camshaft 3. They are spaced from each other along the camshaft axis to avoid interference with valve lifters 11

The VO cams 8, 8 have the same profile. Cam faces 8*b* of the VO cams 8, 8 are the same as those of the VO cams used in the first preferred implementation. Each cam face 8*b* includes a base circle portion 8*e* and a lift portion 8*f* (see FIG. 11). Each VO-cam 8 has a projecting radial lever 23 having a slope facing the associated rocker arm 14.

Each rocker arm 14 has one end portion 14*c* in sliding contact with the associated driver cam 4 and the other end portion 14*d* in sliding contact with the slope of the projecting radial lever 23 of the associated VO cam 8. The reference characters $P_3$ and $P_4$ designate an axis of the PC cam 13A and that of the PC cam 13B, respectively.

For further information on construction and operation of this VVA apparatus, reference should be made to UK Patent Application BG 2 323 894 A, which has been hereby incorporated by reference in its entirety.

At a first angular position γa of the control shaft 12, the rocker arm 14 on the first PC cam 13A takes the position illustrated by the fully drawn line in FIG. 10, and the rocker arm 14 on the second PC cam 13B takes the position illustrated by the phantom line in FIG. 10, At a second angular position γb of the control shaft 12, the rocker arm 14 on the First PC cam 13A takes the position illustrated by the fully drawn line in FIG. 11, and the rocker arm 14 on the second PC cam 13B takes the position illustrated by the phantom line in FIG. 11.

FIGS. 12 to 18(C) illustrate the fifth preferred implementation according to the present invention.

Figure 12:
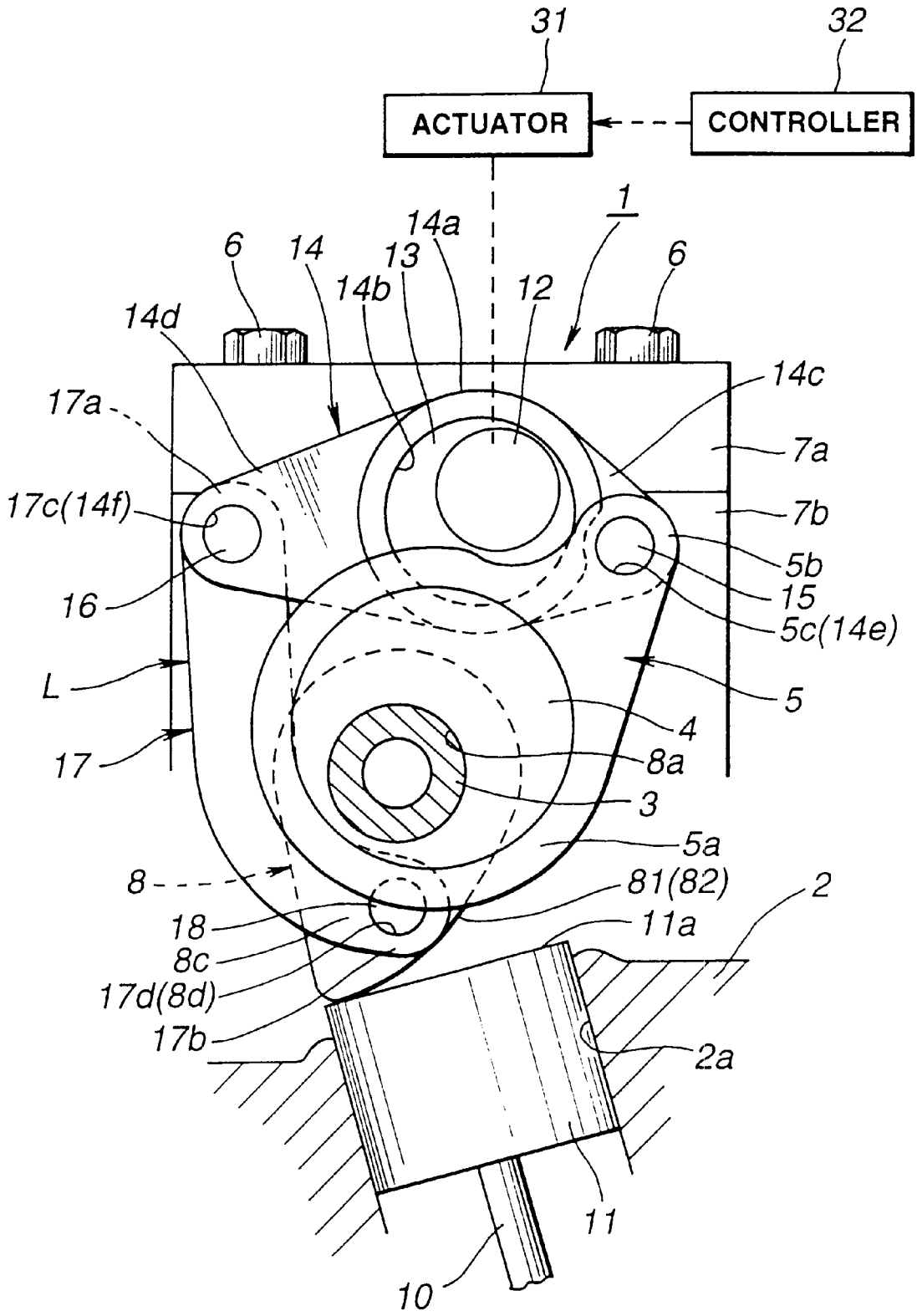
FIG. 12 illustrates diagrammatically, in a cross sectional view, a cylinder head portion of an internal combustion engine equipped with a fifth embodiment of a VVA apparatus.
Figure 13:
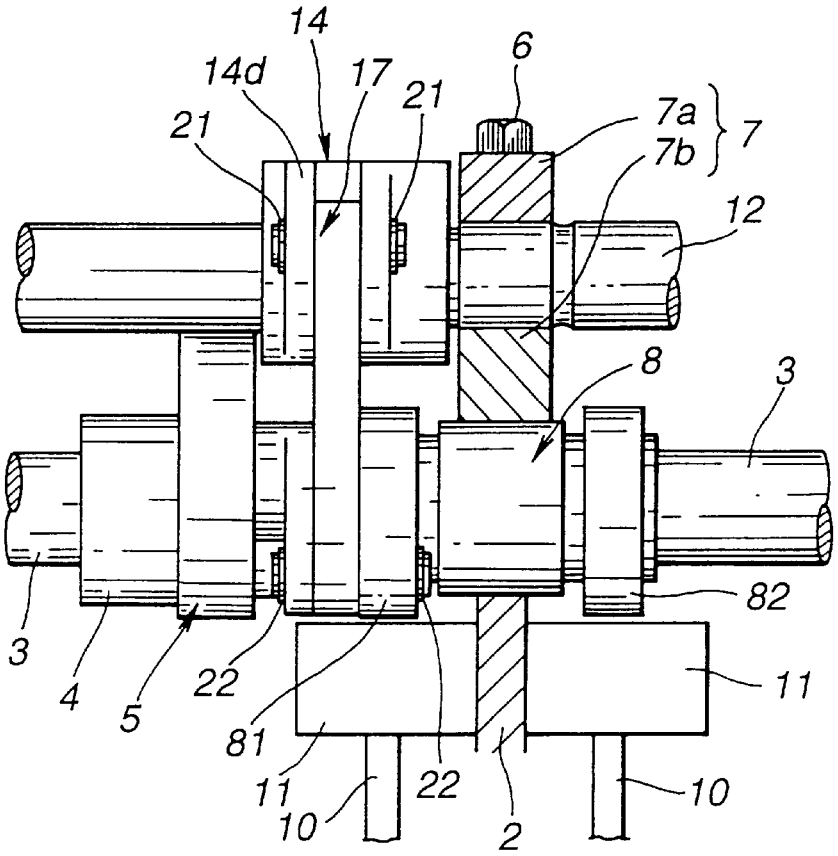
FIG. 13 illustrates diagrammatically, in a front elevation view, the intake valve side of the cylinder head portion shown in FIG. 12.
Figure 14:
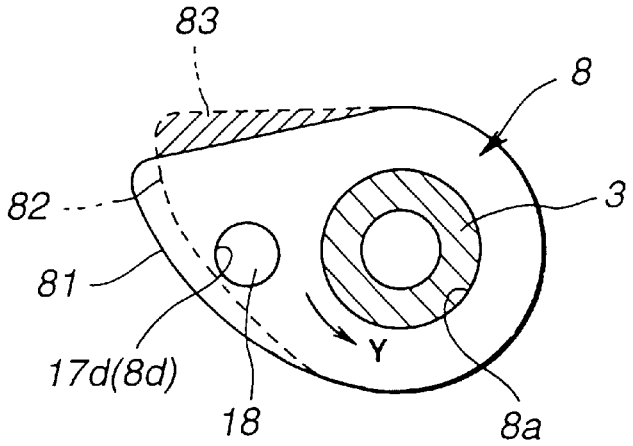
FIG. 14 illustrates the profile a valve operating (VO) cam of the fifth embodiment of the VVA apparatus.

A VVA apparatus illustrated in FIGS. 12 and 13 substantially the same as the VVA apparatus illustrated in FIGS. 1 to 3. The VVA apparatus is different from that shown in FIGS. 1 to 3 in the structure of a mechanism to convert rotational motion of a camshaft 3 into pivotal motion of a first VO cam and a second VO cam. The first VO cam has a cam face 82 and a second VO cam a cam face 81 (see FIG. 13). This first VO cam with the cam face 82 is connected to the second VO cam with the cam face 81. Specifically, the first and second cams are interconnected to form an integral cam assembly 8 mounted to the camshaft 3 for pivotal motion. The motion converting mechanism includes a driver cam 4 fixedly mounted to the camshaft 3, a PO cam 13 fixedly mounted to a control shaft 12, and a linkage system L. The linkage system L, which interconnects the driver cam 4 and the second VO cam, includes a crank arm 14 mounted to the PO cam for pivotal motion.

Figure 15:
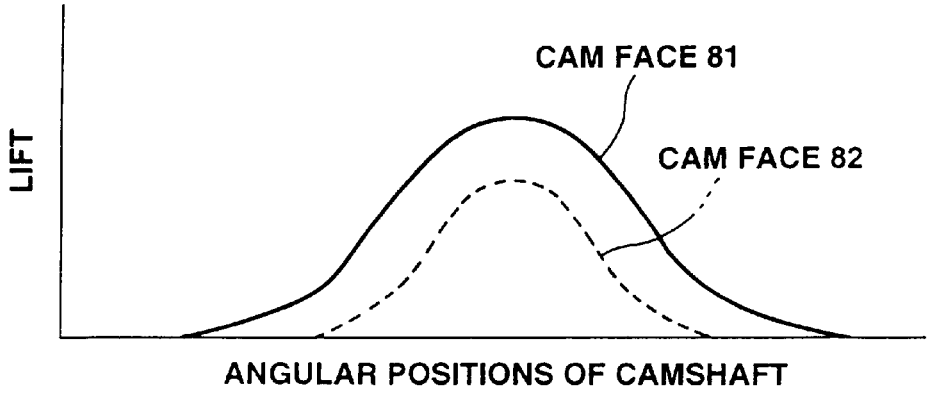
FIG. 15 is a valve lift diagram according to the fifth embodiment.

FIG. 15 is a valve lift diagram employed in the fifth preferred implementation. The fully drawn line draws a valve lift curve provided by the cam face 81 on the second VO cam. The broken line draws a valve lift curve provided by the cam face 82 on the first VO cam.

As readily seen from FIG. 15, the cam face 81 on the second VO cam comes into abutting engagement with the associated valve lifter 11 before the cam face 82 on the first VO cam comes into abutting engagement the other valve lifter 11. This causes the cam race 81 on the second VO cam to open the associated intake valve 10 before the cam face 82 on the first VO cam opens its associated intake valve 10. Both the first and second VO cams are interconnected for pivotal motion as a unit, so that they can pivot through the same angle, The cam face 82 that is retarded in phase from the cam face 81 closes the associated intake valve 10 before the cam face 81 closes the associated intake valve 10. Thus, the valve lift curve with regard to the cam face 82 features a relatively short valve open duration with a relatively low maximum lift.

Figure 16:
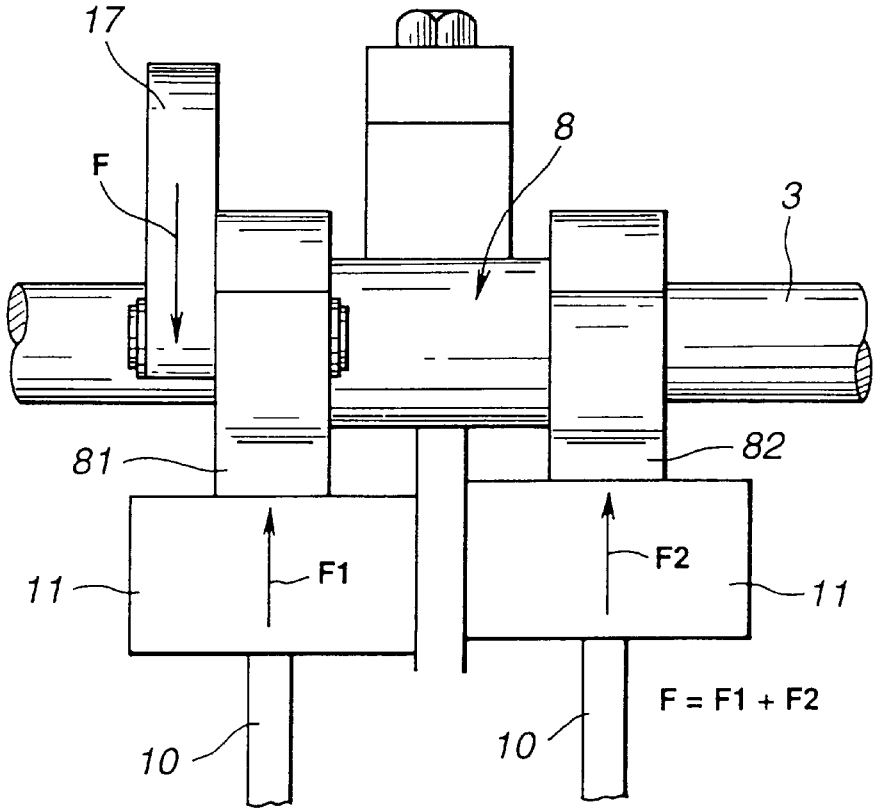
FIG. 16 is a largely simplified view of a portion of FIG. 13 illustrating a force activating a VO cam and reaction forces due to valve springs imparted on cam faces of the VO cam.

FIG. 16 is a very simplified illustration of a portion of FIG. 13. Valve springs, not shown, impart spring forces F2 and F1 to the cam faces 82 and 81 on the first and second VO cams, respectively, inducing a moment tending to tilt the VO cam assembly 8 counterclockwise. There is a clearance between the camshaft 3 and the VO cam assembly 8. This clearance allows the VO cam assembly 8 to tilt. The magnitude of the reaction F due to the spring forces F1 and F2 determines the magnitude of such tilting motion of the VO cam assembly 8.

According to the fifth preferred implementation, the application of force f2 is initiated after application of the force F1 has been initiated and it is terminated before termination of the application of force F1. Besides, the magnitude of force F2 applied to the cam face 82 is less than the magnitude of force F1 applied to the cam face 81. This arrangement suppresses the tendency of the VO cam assembly 8 to tilt, holding each of the cam faces 82 and 81 on the first and second VO cams in a predetermined optimum position with respect to the associated valve lifter 11. As a result, the valve lifters are now free from undesired local wear.

Referring to FIG. 15, the cam face 81 opens the associated intake valve 10 before the cam face 82 opens the associated intake valve 10, admitting intake air into a cylinder past the intake valve 10 opened by the cam face 81 strong enough to generate swirl within the cylinder. This is advantageous in improving combustion efficiency.

In this fifth preferred implementation, the phase of the cam face 82 is retarded from the phase of the cam face 81. Thus, the shadowed portion 83 is no longer needed and has been removed, resulting in a reduction of inertia of the VO cam assembly 8. Such reduction in inertia of the VO cam assembly 8 has enhanced reliability during operation at high speeds.

If the phase of the cam face 81 is advanced with respect to a pin receiving hole 8*d*, the VO cam assembly 8 need to include an additional portion as indicated by shadow in FIG. 17, Thus, this measure is not preferable.

If the phase of the cam face 81 is retarded with respect to the pin receiving hole 8*d*, a link 17 will abut the valve lifter 11 before the cam face 81 comes into abutting engagement with the valve lifter. This measure can not be accepted.

Advancing the phase of the cam face 81 or that of the cam race 82 causes an increase in angle through which the VO cam assembly 8 pivots, impairing quick response upon a shift in mode change initiated by adjustment of the control shaft 12 to a new angular position. This measure is not preferred.

FIGS. 18(A), 18(B) and 18(C) illustrate the sixth preferred implementation according to the present invention. Referring to FIG. 18(C), a cam face 82 of a VO cam assembly 8 is contoured such that it opens one intake valve 10 after valve lift acceleration of the other intake valve 10 opened by a cam face 81 has reached a positive maximum magnitude of acceleration.

With this arrangement, referring to FIG. 18(B), the timing at which the force F2 applied to the cam face 82 by the valve spring reaches its maximum deviates from the timing at which the force F1 applied to the cam face 81 by the valve spring reaches its maximum. In FIG. 18(A), the full drawn line curve results from plotting summation of the forces F2 and F1. For comparison purpose, results from summation of two forces F2 and F1 without such deviation are plotted as illustrated by phantom line. It is now appreciated that resultant force acting on the VO cam assembly 8 has been suppressed as great as ΔW. This is effective in a considerable reduction, in magnitude, of wear at portions on a link 17 and a camshaft 3, which experience sliding engagement with the adjacent portions.

Figure 19:
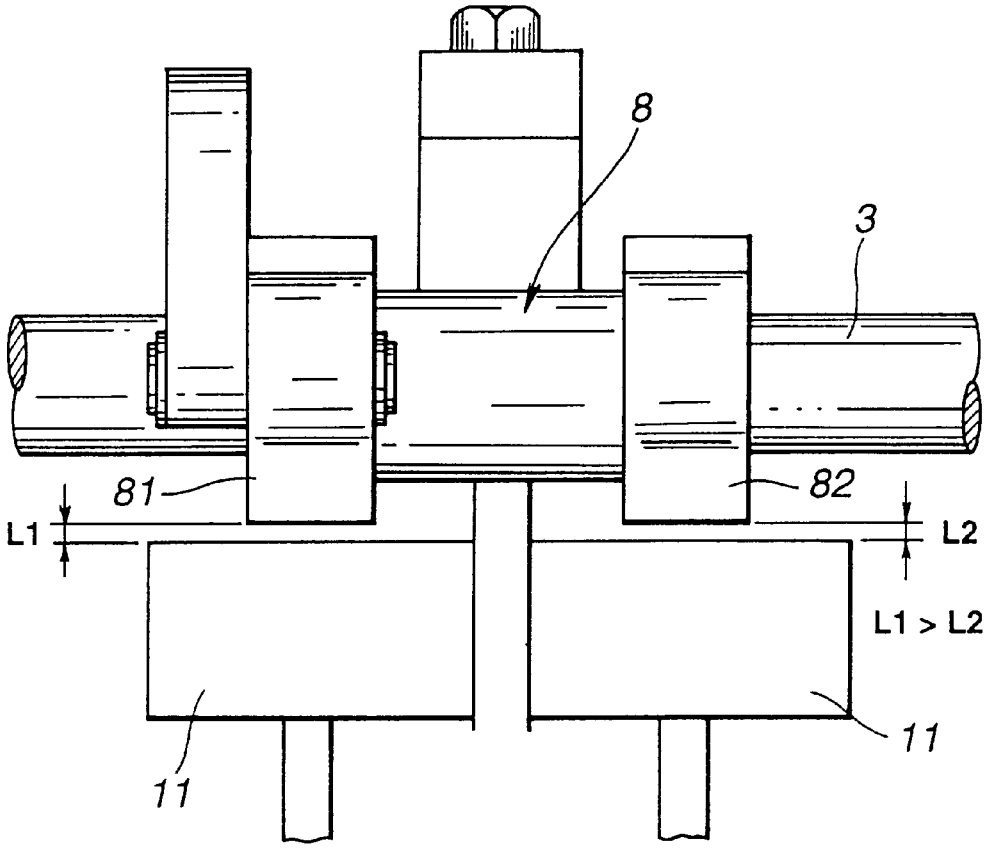
FIG. 19 is a view similar to FIG. 16, illustrating a sixth embodiment of a VVA apparatus according to the present invention.

FIG. 19 illustrates the seventh preferred implementation according to the present invention. According to this preferred implementation, a first clearance L2 that is defined between a cam face 82 and the associated one valve lifter 11 is less than a second clearance L1 that is defined between a cam face 81 and the associated other valve lifter 11 (L1>L2)

The setting of such clearances L2 and L1 (L1>L2) has proven to be effective in suppressing tilting of the VO cam assembly 8 relative to the camshaft 3.

Figure 20:
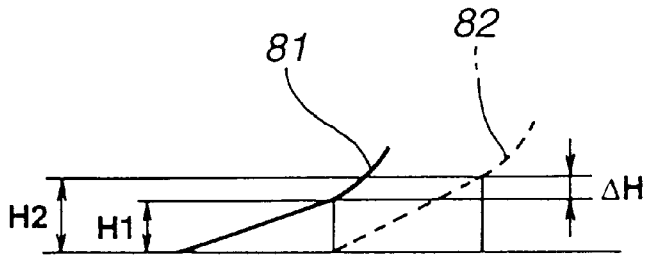
FIG. 20 illustrate varying magnitudes of ramp heights of the first and second cam faces of a VO cam that may be used in the sixth embodiment against varying angles of a camshaft.

FIG. 20 illustrates the eighth preferred implementation according to the present invention. According to this preferred implementation, cam faces 82 and 81 have different ramp heights H2 and H1, respectively. The setting is such that the ramp height H2 is greater than the ramp height H1 by an amount ΔH. This implementation is alternative to the seventh preferred implementation illustrated in FIG. 19 and provides the same result.

Figure 21:
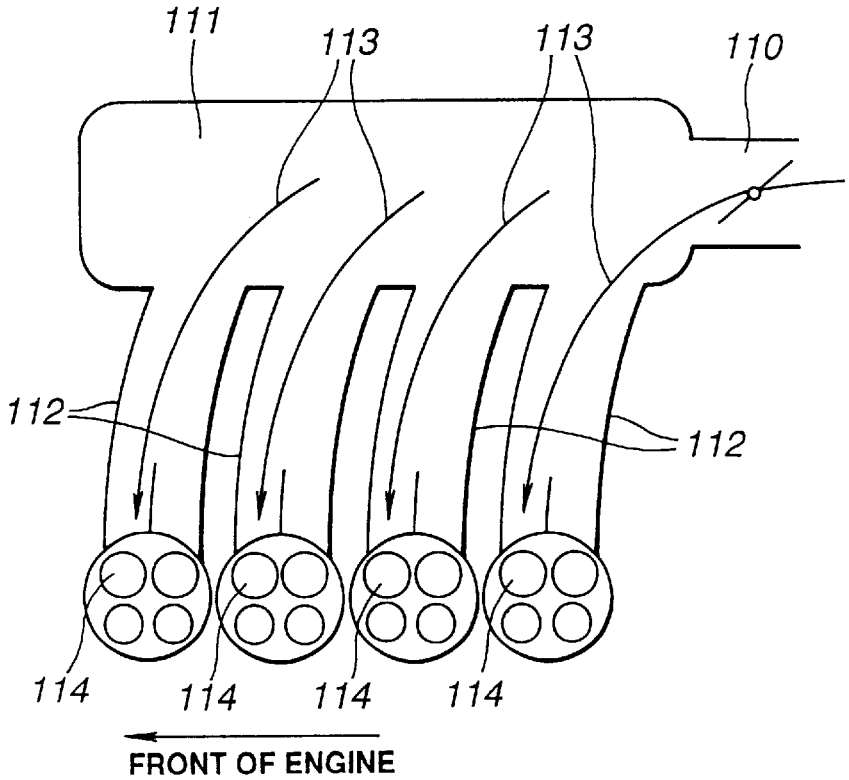
FIG. 21 is a greatly simplified diagrammatic view of a portion of an air intake arrangement associated with four cylinders of an internal combustion engine incorporating any one of the embodiments.

FIG. 21 illustrates the ninth preferred implementation according to the present invention. A diagram of FIG. 21 illustrates flows of intake air through an intake system of a four-cylinder internal combustion engine. Intake air admitted past a throttle chamber 110 into a collector 111 is distributed to the cylinders through branch tubes 112. Relative arrangement among the throttle chamber 110, collector 111, and branch tubes 112 determines flow distribution of intake air within each of the branch rubes 112, Referring to FIG. 21, if intake air is admitted into the collector 11 past the throttle chamber 110 from the rear of the engine, a high-speed flow of intake air is produced at intake ports 114 located nearer to the front of the engine than the cooperating the other intake ports. In this case, the cam face 81 is arranged above each of the intake ports 114 in cooperation with an intake valve so as to open the intake valves for the intake port 114 before opening of intake valves for the other intake ports. This results in strengthening swirl generated within each cylinder.

Figure 22:
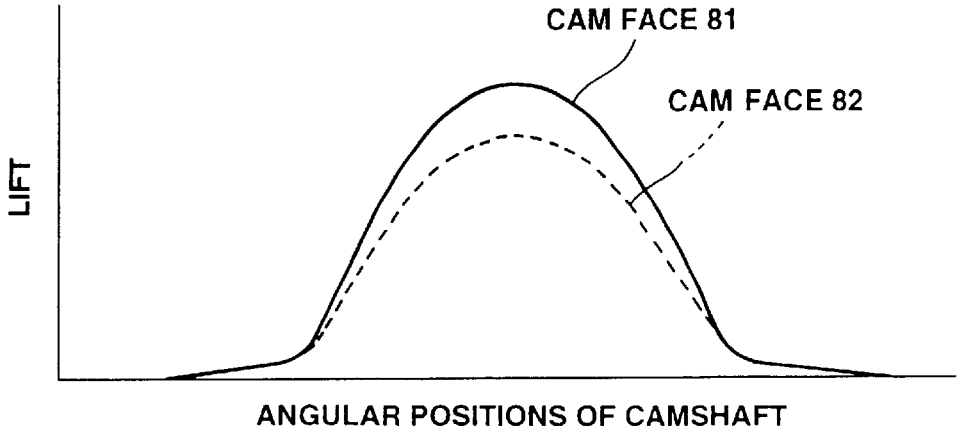
FIG. 22 is a valve lift diagram due to first and second cam faces of other alternative VO cam.

FIG. 22 illustrates the tenth preferred implementation according to the present invention. As readily seen from FIG. 22, both cam faces 82 and 81 provide the same valve opening duration. But, the cam face 82 provides valve lifts always lower the corresponding valve lifts by the cam face 81 over varying angular positions of camshaft 3. In this case, magnitude of force F2 applied to the cam face 82 is kept lower than magnitude of force F1 applied to the cam face 81. Thus, tendency of the VO cam assembly 8 to tilt relative to the camshaft 3 is suppressed. This air intake arrangement introduces intake air as two different flows into each cylinder, producing swirl in the cylinder for improved combustion environment.

The contents of disclosure of Japanese Patent Applications Nos 10-139072 (filed May 21, 1998) and 10-281479 (filed Oct. 2, 1998) are hereby incorporated by reference in their entireties.

Each of the above-described implementations of the present invention is an example implementation. Moreover various modifications to the present invention may occur to those skilled in the art and will fall within the scope of the present invention as set forth below.

What is claimed is:

1. A variable valve actuation apparatus for an internal combustion engine having a plurality of cylinders, comprising:

a first cylinder valve;

a second cylinder valve;

said first and second cylinder valves being arranged for one of the plurality of cylinders to perform one of intake and exhaust phases of the one cylinder;

each of said first and second cylinder valves being biased by a valve spring toward a valve close position thereof;

a camshaft adapted for rotation about a camshaft axis;

a first valve operating cam cooperating with said first cylinder valve, said first valve operating cam being arranged for pivotal motion, about a pivotal axis thereof, to lift said first cylinder valve toward a valve open position thereof against the valve spring thereof;

a second valve operating cam cooperating with said second cylinder valve to lift said second cylinder valve toward a valve open position thereof against the valve spring thereof;

a control shaft adjustable to varying angular positions with respect to a control shaft axis; and a mechanism to convert rotational motion of said camshaft into pivotal motion of said first valve operating cam, said mechanism having different states corresponding to said varying angular positions which said control shaft is adjustable to, respectively and being continuously variable in state to one of said different states in response to a shift of said control shaft to one of said varying angular positions, said mechanism being operative to vary said first valve operating cam, in position, relative to said first cylinder valve in response to a shift between said different states, wherein said second valve operating cam being arranged for pivotal motion about a pivotal axis thereof, wherein said mechanism is operative to convert rotational motion of said camshaft into pivotal motion of said second valve operating cam, and wherein said mechanism is operative to vary said second valve operating cam, in position, relative to said second cylinder valve in response to a shift between said different states, and wherein said mechanism is operative to cause said first and second valve operating cams to provide first valve open timing and second valve open timing, respectively, with a difference between said first and second valve open timings varying against the varying angular positions to which said control shaft is adjustable.

2. A variable valve actuation apparatus for an internal combustion engine having a plurality of cylinders, comprising:

a first cylinder valve;

a second cylinder valve;

said first and second cylinder valves being arranged for one of the plurality of cylinders to perform one of intake and exhaust phases of the one cylinder;

each of said first and second cylinder valves being biased by a valve spring toward a valve close position thereof;

a camshaft adapted for rotation about a camshaft axis;

a first valve operating cam cooperating with said first cylinder valve, said first valve operating cam being arranged for pivotal motion, about a pivotal axis thereof, to lift said first cylinder valve toward a valve open position thereof against the valve spring thereof;

a second valve operating cam cooperating with said second cylinder valve to lift said second cylinder valve toward a valve open position thereof against the valve spring thereof;

a control shaft adjustable to varying angular positions with respect to a control shaft axis; and a mechanism to convert rotational motion of said camshaft into pivotal motion of said first valve operating cam, said mechanism having different states corresponding to said varying angular positions which said control shaft is adjustable to, respectively, and being continuously variable in state to one of said different states in response to a shift of said control shaft to one of said varying angular positions, said mechanism being operative to vary said first valve operating cam, in position, relative to said first cylinder valve in response to a shift between said different states, wherein said second valve operating cam being arranged for pivotal motion about a pivotal axis thereof, wherein said mechanism is operative to convert rotational motion of said camshaft into pivotal motion of said second valve operating cam, and wherein said mechanism is operative to vary said second valve operating cam, in position, relative to said second cylinder valve in response to a shift between said different states, and wherein said mechanism is operative to cause said first and second valve operating cams to provide first and second valve open timings, respectively, with a difference between said first and second valve open timings varying against the varying angular positions to which said control shaft is adjustable, wherein said first and second valve open timings generally concur when said control shaft is adjusted to a predetermined angular position of the varying angular positions.

3. A variable valve actuation apparatus for an internal combustion engine having a plurality of cylinders, comprising:

a first cylinder valve;

a second cylinder valve;

said first and second cylinder valves being arranged for one of the plurality of cylinders to perform one of intake and exhaust phases of the one cylinder;

each of said first and second cylinder valves being biased by a valve spring toward a valve close position thereof;

a camshaft adapted for rotation about a camshaft axis;

a first valve operating cam cooperating with said first cylinder valve, said first valve operating cam being arranged for pivotal motion, about a pivotal axis thereof, to lift said first cylinder valve toward a valve open position thereof against the valve spring thereof;

a second valve operating cam cooperating with said second cylinder valve to lift said second cylinder valve toward a valve open position thereof against the valve spring thereof;

a control shaft adjustable to varying angular positions with respect to a control shaft axis; and a mechanism to convert rotational motion of said camshaft into pivotal motion of said first valve operating cam, said mechanism having different states corresponding to said varying angular positions which said control shaft is adjustable to, respectively, and being continuously variable in state to one of said different states in response to a shift of said control shaft to one of said varying angular positions, said mechanism being operative to vary said first valve operating cam, in position, relative to said first cylinder valve in response to a shift between said different states, wherein said second valve operating cam being arranged for pivotal motion about a pivotal axis thereof, wherein said mechanism is operative to convert rotational motion of said camshaft into pivotal motion of said second valve operating cam, and wherein said mechanism is operative to vary said second valve operating cam, in position, relative to said second cylinder valve in response to a shift between said different states, and wherein said mechanism includes:

a first driver cam fixedly mounted to said camshaft;

a second driver cam fixedly mounted to said camshaft and spaced along said camshaft axis from said first driver cam;

a first position controlling cam fixedly mounted to said control shaft;

a second position controlling cam fixedly mounted to said control shaft and spaced along said control shaft axis from said first position controlling cam;

a first linkage system including a first rocker arm mounted to said first position controlling cam for pivotal motion, said first linkage system interconnecting said first driver cam and said first valve operating cam; and a second linkage system including a second rocker arm mounted to said second position controlling cam for pivotal motion, said second linkage system interconnecting said second driver cam and said second valve operating cam;

said first position controlling cam being a circular cam eccentrically mounted to said control shaft with a first predetermined eccentricity in amount and in phase with respect to the control shaft axis, said second controlling cam being a circular cam eccentrically mounted to said control shaft with a second predetermined eccentricity in amount and in phase with respect to the control shaft axis, said first predetermined eccentricity in phase being retarded from said second predetermined eccentricity in phase with respect to a direction of rotational direction of said control shaft to bring an axis of said first position controlling cam into the nearest distance from said camshaft, and said first predetermined eccentricity in amount being greater than said second predetermined eccentricity in amount.

* * * * *